US011554281B2

(12) United States Patent
Johnston

(10) Patent No.: US 11,554,281 B2
(45) Date of Patent: Jan. 17, 2023

(54) HEADSTAND BENCH

(71) Applicant: Innes Imports Pty Ltd., Cowes (AU)

(72) Inventor: Marni Nicole Johnston, Cowes (AU)

(73) Assignee: Fit With Her Pty Ltd., Cowes (AU)

( * ) Notice: Subject to any disclaimer, the term of this patent is extended or adjusted under 35 U.S.C. 154(b) by 0 days.

(21) Appl. No.: 17/511,842

(22) Filed: Oct. 27, 2021

(65) Prior Publication Data

US 2022/0143447 A1 May 12, 2022

Related U.S. Application Data

(60) Provisional application No. 63/112,064, filed on Nov. 10, 2020.

(51) Int. Cl.
*A63B 21/00* (2006.01)
*A47C 9/00* (2006.01)

(52) U.S. Cl.
CPC ..... *A63B 21/0005* (2013.01); *A47C 9/002* (2013.01)

(58) Field of Classification Search
CPC ..... A63B 21/0005; A63B 2220/20; A63B 21/0442; A63B 21/4029; A63B 21/0058; A63B 21/4033; A63B 2225/102; A63B 2225/09; A63B 2225/20; A63B 23/0405; A63B 2023/0411; A63B 23/1209; A63B 23/1227; A63B 23/1236; A63B 21/078; A63B 21/4045; A63B 71/0622; A63B 2208/0223; A63B 2208/0233; A63B 2210/50; A63B 2225/10; A63B 2225/50; A63B 2209/10; A63B 2208/0252; A47C 9/002; A47C 11/00
See application file for complete search history.

(56) References Cited

U.S. PATENT DOCUMENTS 2,919,918 A * 1/1960 Clarence ..... A63B 21/00054 482/142
3,114,545 A * 12/1963 Clarence ..... A63B 21/00054 482/142
3,173,415 A * 3/1965 Rubin ..... A63B 21/023 482/142

(Continued)

FOREIGN PATENT DOCUMENTS

CN 105661986 6/2016
CN 108970024 12/2018

(Continued)

*Primary Examiner* — Garrett K Atkinson
(74) *Attorney, Agent, or Firm* — Eric Karich; Karich & Associates

(57) ABSTRACT

A headstand bench has a bench frame having front and rear pairs of legs connected by a pair of upper rails, and a pair of lower rails extending longitudinally between the front and rear pairs of legs, beneath the pair of upper rails. A headstand plate is mounted on the pair of upper rails adjacent the rear pair of legs, the headstand plate having a first inner edge that includes an inwardly extending recessed area that is sized and shaped for performing headstand exercises. A removable rigid plate is adapted to be removably mounted on the pair of upper rails, and includes a second inner edge that removably interlocks with the first inner edge of the headstand plate. A removable cushion is removably mounted on the removable rigid plate. The removable rigid plate may also be secured on the pair of lower rails.

14 Claims, 8 Drawing Sheets

(56) References Cited

U.S. PATENT DOCUMENTS 3,379,434 A * 4/1968 Guzaldo ..... A63B 23/00 482/139
3,591,173 A * 7/1971 Cossman ..... A63B 21/00054 482/142
3,879,033 A * 4/1975 Martin ..... A63B 21/00047 482/142
4,133,524 A * 1/1979 Barlew ..... A63B 21/00054 482/142
4,337,942 A * 7/1982 Sidlinger ..... A63B 23/0211 482/145
5,095,556 A * 3/1992 Franey ..... A47K 17/026 4/483
5,221,246 A * 6/1993 Torii ..... A63B 21/00054 482/121
5,526,537 A * 6/1996 Conrad ..... A47K 11/04 297/188.12
5,569,141 A * 10/1996 Chou ..... A63B 21/00054 482/40
5,643,163 A * 7/1997 Chen ..... A63B 21/00054 482/142
6,491,611 B1 * 12/2002 Stearns ..... A63B 21/0552 482/142
7,144,353 B2 * 12/2006 Sjuragari ..... A63B 23/0233 482/142
8,632,446 B2 * 1/2014 Solow ..... A63B 23/03525 482/148
8,641,585 B2 * 2/2014 LaGree ..... A63B 22/203 482/92
9,220,359 B2 * 12/2015 Long ..... A63B 23/0216
9,463,352 B2 * 10/2016 Davidow ..... A63B 23/0238
9,789,346 B1 * 10/2017 Kime ..... A63B 23/1227
10,251,488 B2 4/2019 Lan
10,905,243 B2 * 2/2021 Lan ..... A47C 7/628
D923,346 S * 6/2021 Kambara ..... D6/349
2002/0128576 A1 * 9/2002 Mayes ..... A61H 1/0292 602/33
2010/0081551 A1 * 4/2010 Harley ..... A63B 21/0005 482/142
2015/0057127 A1 * 2/2015 Lagree ..... A63B 21/00069 482/142
2015/0151159 A1 * 6/2015 Davidow ..... G09B 19/003 434/257
2017/0239124 A1 * 8/2017 Cunningham ..... A63B 21/4043
2019/0200770 A1 * 7/2019 Lan ..... A61H 15/00

FOREIGN PATENT DOCUMENTS

JP 3078264 6/2001
KR 20-1998-0229585 8/1998

* cited by examiner

HEADSTAND BENCH

CROSS-REFERENCE TO RELATED APPLICATIONS

This application for a utility patent claims the benefit of U.S. Provisional Application No. 63/112,064, filed Nov. 10, 2020.

BACKGROUND OF THE INVENTION

Field of the Invention

This invention relates generally to headstand benches, and more particularly to a headstand bench that can also be used for performing additional physical exercises and for measuring flexibility.

Description of Related Art

The prior art teaches various forms of headstand devices for assisting a user in performing headstands. For example, Torii, U.S. Pat. No. 5,221,246, teaches a headstand apparatus that is adapted for supporting a user in an inverted position supported on their shoulders that includes foot members, an abdomen rest member, a support member, a pair of shoulder rest members that are disposed between the abdomen rest member and support member, and a pair of grip members that are disposed below the shoulder members. To use the apparatus, a user first bends their abdominal region over the abdomen rest member, positioning their shoulders above the shoulder rest members and grasps the grip members with their hands. They then rest their shoulders onto the shoulder rest members with their head fitted between which shoulder rest members. The user then pivots their hips and knees away from the abdomen rest member, straightening their legs, that engage the support member, at the backs of the legs or their hips, the support member supporting their legs in an inverted position.

Lan, U.S. Pat. No. 10,251,488, teaches a yoga stool that includes a seat portion and a base portion. The base portion has window slots formed in a front side, a rear side, or both. A handle slot is formed at least in one side, such as the front side, at or near the top; horizontal gripping slots are formed in the left side, the right side, or both, at or near the top; and vertical gripping slots are formed in the left side, the right side, or both, at or near the bottom. The yoga stool may also have a base portion, and a seat portion on top of the base portion, wherein the seat portion has an internal firm support member such as a solid slat, and preferably softer material such as foam rubber surrounding the support member, at least on the left and right sides.

SUMMARY OF THE INVENTION

The present invention teaches certain benefits in construction and use which give rise to the objectives described below.

The present invention provides a headstand bench that includes a bench frame having a front pair of legs, a rear pair of legs, each of the front and rear legs having a top end and a bottom end. The bench frame further includes a pair of upper rails extending a longitudinal length between the top ends of the front pair of legs, to the top ends of the rear pair of legs, the pair of upper rails being laterally spaced a width. The bench frame further includes a pair of lower rails extending longitudinally between the front pair of legs to the pair of rear legs, beneath the pair of upper rails. A headstand plate is fixedly mounted on the pair of upper rails adjacent the rear pair of legs, the headstand plate having a first inner edge that includes an inwardly extending recessed area that is sized and shaped for performing headstand exercises. A removable rigid plate is adapted to be removably mounted on the pair of upper rails adjacent the front pair of legs, the removable rigid plate having a second inner edge that removably interlocks with the first inner edge of the headstand plate. A removable cushion is removably mounted on the removable rigid plate. The bench further includes a means of removably securing the removable rigid plate to the pair of lower rails.

A primary objective of the present invention is to provide a headstand bench having advantages not taught by the prior art.

Another objective is to provide a headstand bench that is convertible into multiple configurations for performing different physical activities.

A further objective is to provide a headstand bench adapted to be used as a piece of furniture when not in use for performing headstands.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a headstand bench for performing physical exercises, wherein the headstand bench may be converted into various other types of furniture or exercise apparatuses.

Figure 1:
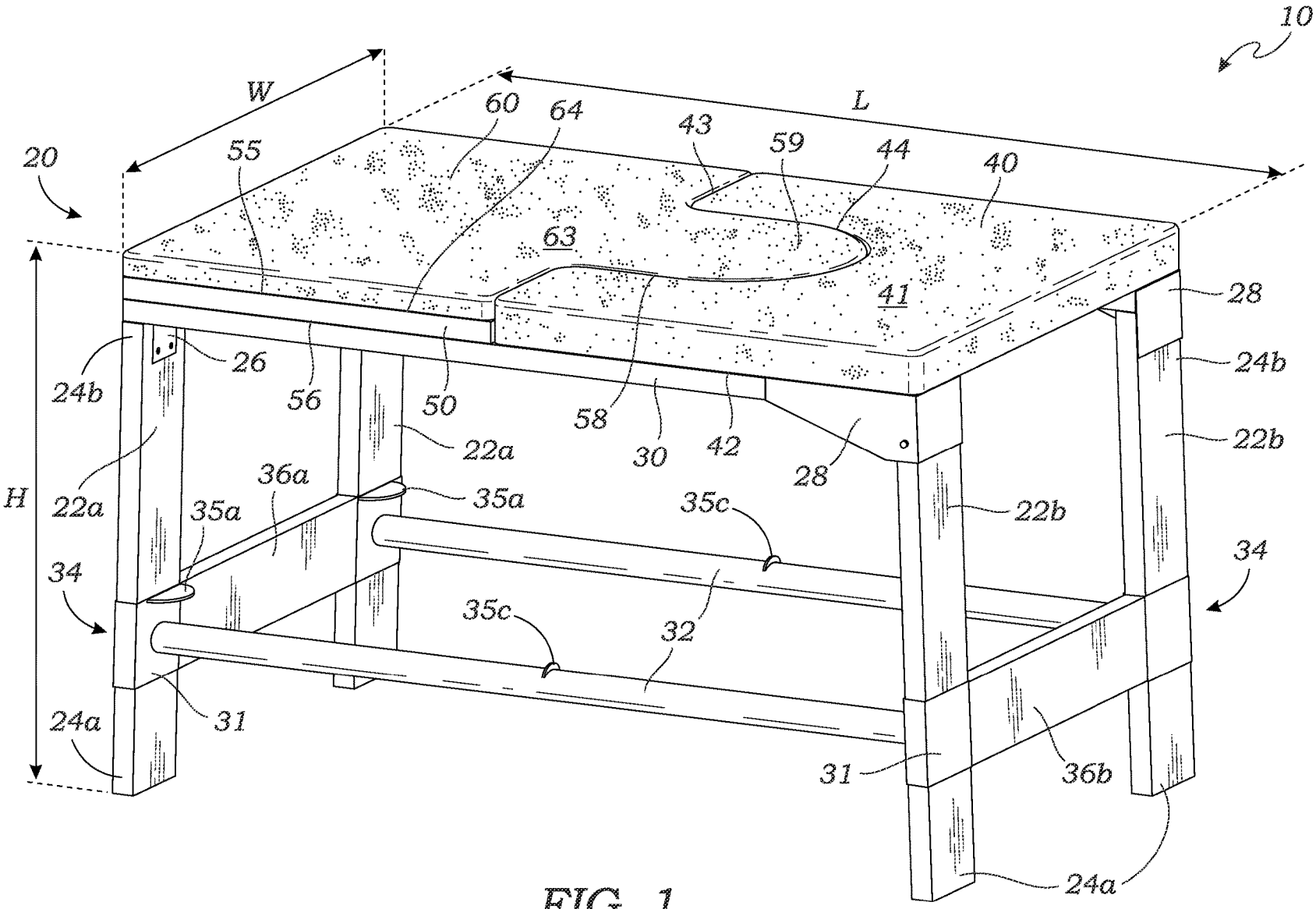
FIG. 1 is a top perspective view of a headstand bench according to one embodiment of the present invention.
Figure 2:
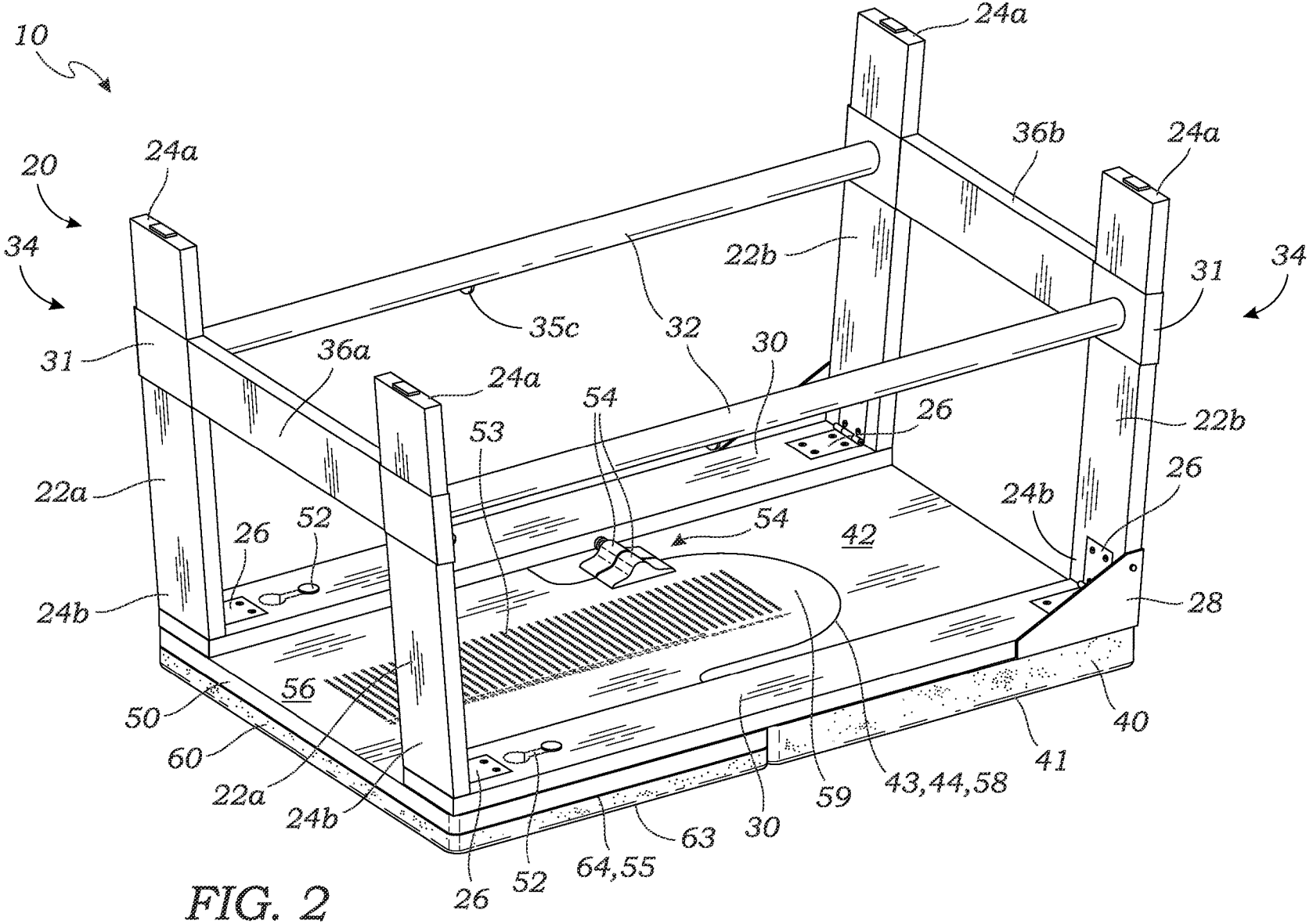
FIG. 2 is a bottom perspective view thereof.

FIG. 1 is a top perspective view of a headstand bench 10 according to one embodiment of the present invention, and FIG. 2 is a bottom perspective view thereof. As shown in FIGS. 1-2, the headstand bench 10 comprises a bench frame 20 having a front pair of legs 22*a* and a rear pair of legs 22*b*, each of the front and rear legs 22 including a bottom end 24*a* that extends a height H to a top end 24*b*. In this embodiment, H is between approximately 10-20 inches. A pair of upper rails 30 extend a longitudinal length L between the top ends 24*b* of the front pair of legs 22*a*, to the top ends 24*b* of the rear pair of legs 22*b*, the pair of upper rails 30 being laterally spaced a width W. In the current embodiment, L may be between approximately 20-35 inches, and W may be between approximately 8-20 inches; however, the dimensions of H, L, and W may be provided in alternative measurements than disclosed herein, and these alternative embodiments should be considered within the scope of the present invention.

As shown in FIG. 2, in this embodiment, the front and rear pairs of legs 22 are attached to the pair of upper rails 30 via hinges 26, though other means of attachment may be used, via any known means in the art, e.g., an alternative form of hinge, a fixed attachment such as bolts, etc. In this embodiment, a locking bracket 28 is attached to the top ends 24*b* of the rear pair of legs 22*b* and the pair of upper rails 30, discussed in greater detail below.

As shown in FIGS. 1-2, the bench frame 20 further includes a pair of lower rails 32 having ends 31 and extending longitudinally between the front pair of legs 22*a* to the pair of rear legs 22*b* beneath the pair of upper rails 30. As illustrated, in this embodiment, the pair of lower rails 32 are tubular in construction and include a means of removably attaching 34 the pair of lower rails 32 to the front and rear pairs of legs 22, discussed in greater detail below. Alternatively, any suitable structure may be used for the pair of lower rails 32 (e.g., rods, planks, etc.), provided they interrelate and function as described herein.

In some embodiments, the bench frame 20 may also include a front cross-panel 36*a* extending laterally between the front pair of the legs 22 and positioned between the top and bottom ends 24, and a rear cross-panel 36*b* extending laterally between the rear pair of legs 22*b*, positioned between the top and bottom ends 24. However, in alternative embodiments, the cross-panels 36 may not be included. In the configuration illustrated in FIG. 1, the longitudinal length L of the bench frame 20 is greater than the lateral width W, providing stability for the headstand bench 10 to be sat or stepped upon.

As shown in FIGS. 1-2, the headstand bench 10 further comprises a headstand plate 40 fixedly mounted on the pair of upper rails 30 adjacent the rear pair of legs 22*b*, the headstand plate 40 having a cushioned top surface 41, a bottom surface 42, and a first inner edge 43 that includes an inwardly extending recessed area 44 that is sized and shaped for performing headstand exercises. Furthermore, a removable rigid plate 50 is adapted to be removably mounted on the pair of upper rails 30 adjacent the front pair of legs 22*a* via a fastener 52, the fastener 52 being best shown in FIG. 4 and discussed in more detail below. The removable rigid plate 50 includes a top surface 55, a bottom surface 56, and a second inner edge 58 that removably interlocks with the first inner edge 43 of the headstand plate 40. In this embodiment, the second inner edge 58 includes a tab portion 59 that follows the line of the inwardly extending recessed area 44 of the headstand plate 40 when both plates 40 and 50 and are mounted on the bench frame 20.

As illustrated, the removable rigid plate 50 further includes a removable cushion 60 removably mounted on the top surface 55 of the removable rigid plate 50 via an attachment mechanism 62, the removable cushion 60 having a top surface 63 and a bottom surface 64 and being the same general shape as the rigid removable plate. The attachment mechanism 62 is best shown in FIG. 3 and is discussed in greater detail below.

As shown in FIG. 2, the bottom surface 56 of the removable rigid plate 50 may further include a ruler 53 extending longitudinally from the inner edge 58 to the opposite edge of the removable rigid plate 50, discussed in greater detail below. The bottom surface 56 may further have a locking mechanism 54 for securing the inner edges 43 and 58 of the headstand plate 40 and the removable rigid plate 50 in an interlocked position. In this embodiment, the locking mechanism 54 is in the form of a side-pull latch, wherein a keeper (female) body 54*a* is mounted on the bottom surface of the headstand plate 40 adjacent the recessed area 44, and a latch (male) body 54*b* is mounted on the bottom surface 56 of the removable rigid plate 50, the latch body 54*b* being adjacent the keeper body 54*a* of the headstand plate 40 when both plates 40 and 50 are mounted on the bench frame 20. In this embodiment, the keeper body 54*a* and the latch body 54*b* are offset from each other by approximately 5 mm. However, the keeper body 54*a* and the latch body 54*b* may be more closely aligned or be offset by a different amount. Further, in alternative embodiments, the locking mechanism 54 may be a different type of latch or fastener, e.g., a hook-and-loop fastener, a buckle, press-studs, etc., or any other type of suitable locking mechanism known in the art. Further securing mechanisms for securing the headstand bench 10 in an assembled configuration may also be included (e.g., additional screws, adhesives, etc.), as determined by one skilled in the art.

Figure 3:
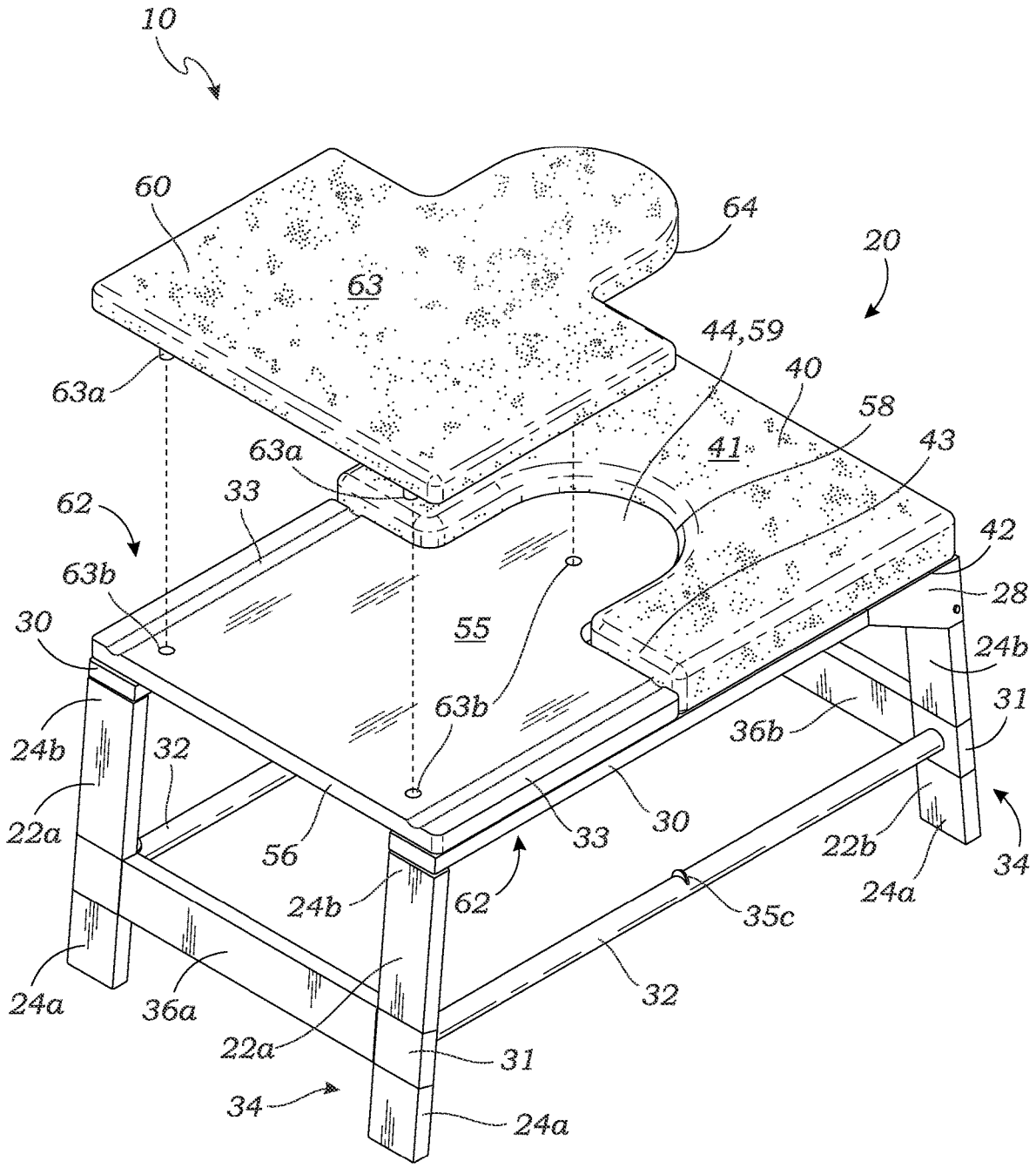
FIG. 3 is a top perspective view of the headstand bench, showing a removable cushion exploded out from the headstand bench.

FIG. 3 is a top perspective view of the headstand bench 10, showing the removable cushion 60 exploded from the removable rigid plate 50. As shown in FIG. 3, the removable cushion 60 may be removably mounted on the top surface 55 of the removable rigid plate 50 via the attachment mechanism 62. In this embodiment, the attachment mechanism 62 is in the form of a plurality of pegs 63*a* formed in the bottom surface 64 of the removable cushion 60 and a plurality of receiving holes 63*b* of the removable rigid plate 50, wherein the plurality of pegs 63*a* and the plurality of receiving holes 63*b* align when the removable cushion 60 is mounted on the removable rigid plate 50. However, in alternative implementations of the present invention, the attachment mechanism 62 may be any other similar type of mechanism (e.g., clips, hook and loop fasteners, pins, etc.).

Figure 4:
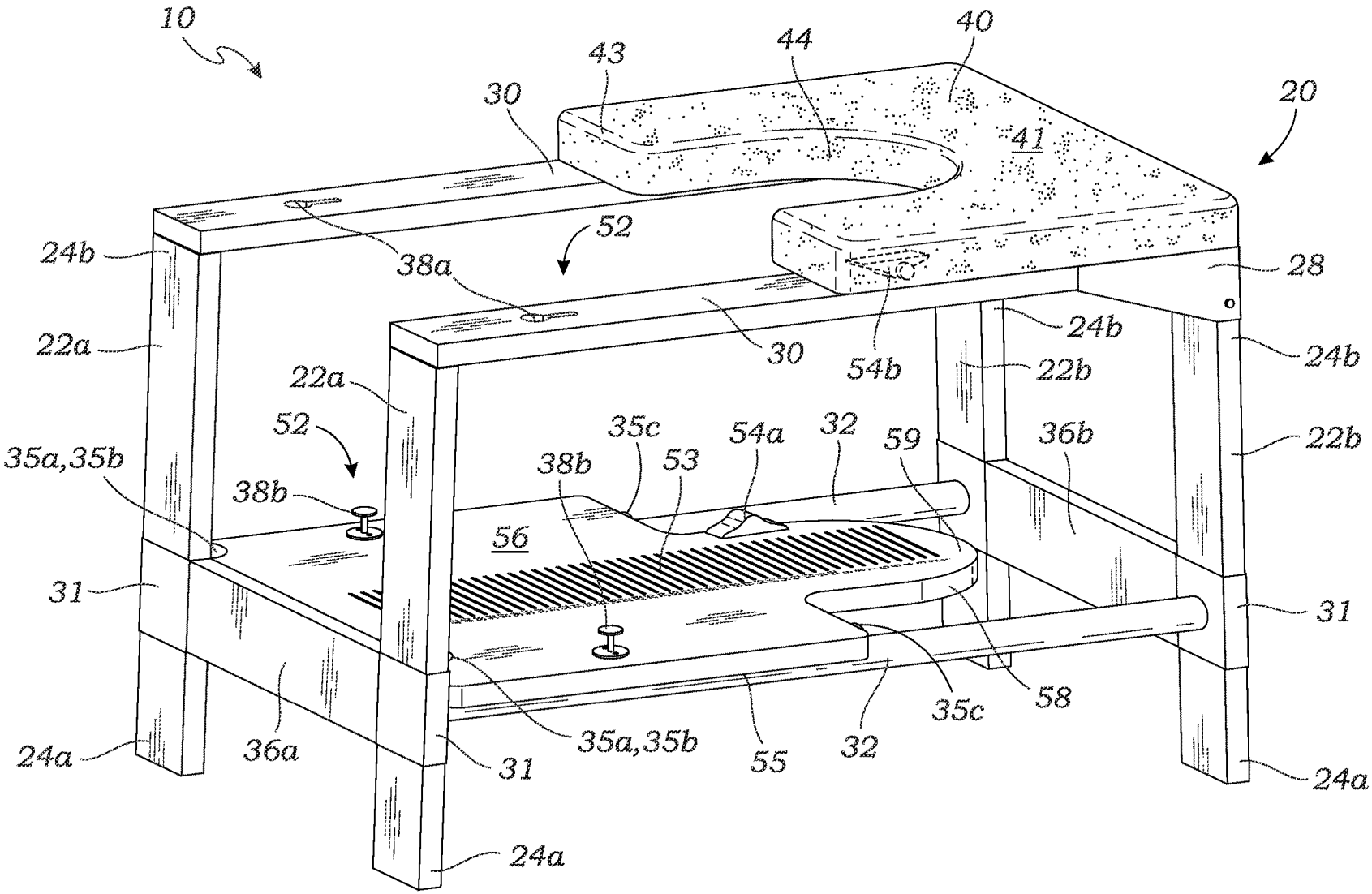
FIG. 4 is a top perspective view of the headstand bench, showing a removable rigid plate mounted on the headstand bench in an alternative position.

As shown in FIG. 3, in this embodiment, the means of attaching 34 the removable rigid plate 50 to the pair of lower rails 32 includes a pair of channels 33 formed in the top surface 55 of the removable rigid plate 50, wherein the pair of channels 33 are positioned such that they receive the pair of lower rails 32 when the bottom surface 56 of the removable rigid plate 50 is facing upwardly and mounted on the pair of lower rails 32 (shown in FIG. 4). In other embodiments, the means of attaching 34 may instead be another form of indents in the top surface 55 of the rigid plate 50, or a protruding structure such as a clip.

FIG. 4 is a top perspective view of the headstand bench 10, showing the removable rigid plate 50 mounted on the pair of lower rails 32. As shown in FIG. 4, in this embodiment, the means of attaching 34 further includes an inwardly extending tab 35*a* on each end 31 of the pair of lower rails 32 that contacts the pair of front legs 22*a*. Further, a pair of indents 35*b* are formed in the bottom surface 56 of the removable rigid plate 50 that receive the tabs 35*a* when the removable rigid plate 50 is mounted on the pair of lower rails 32. In this embodiment, an upwardly extending tab 35*c* also extends upwardly from each of the pair of lower rails 32 and contacts the inner edge 58 of the removable rigid plate 50 to further secure it in place. However, in alternative embodiments, the tabs and indents 35 may not be included, or an alternative means for securing may be implemented, e.g., clips, pegs, straps, etc.

As shown in FIG. 4, the removable rigid plate 50 is mounted on the pair of upper rails 30 of the bench frame 20 via the fastener 52, and the headstand plate 40 is mounted on the pair of upper rails 30 via bolts (not shown). In this embodiment, the fastener 52 is in the form of a pair of clip receivers 38*a* of the upper rails 30, and a pair of clips 38*b* on the bottom surface 56 of the removable rigid plate 50, wherein the pair of clip receivers 38*a* and the pair of clips 38*b* align and interlock when the removable rigid plate 50 is mounted on the bench frame 20. However, in other embodiments, each plate may be mounted to the bench frame 20 via any equivalent means, as determined by one skilled in the art. Further, the headstand cushion may also be removably attached for replacement/cleaning/etc., or for converting the bench frame 20 for various different uses.

As shown in FIGS. 1-4, the removable rigid plate 50 may be mounted on the pair of upper rails 30, wherein a user may sit on the headstand bench 10 or perform exercises such as a high-step, or any other related exercises known in the art. When the removable rigid plate 50 is removed from the bench frame 20, a user may either perform headstand exercises using the inwardly extending recessed area 44, and/or the removable rigid plate 50 may be mounted on the pair of lower rails 32. In the configuration of FIG. 4, a user may perform other exercises such as a low step, or any other related exercises known to those skilled in the art.

Figure 5:
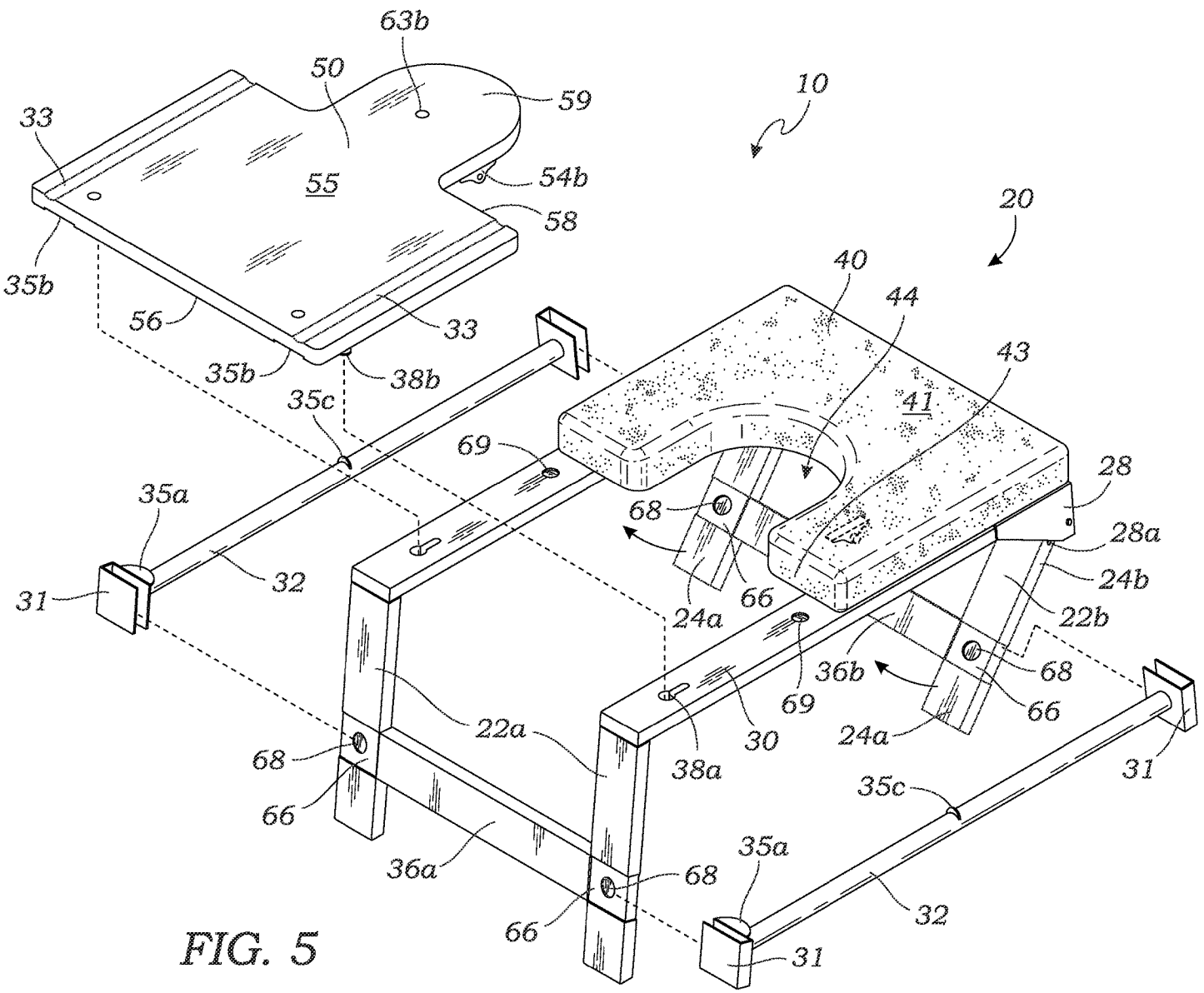
FIG. 5 is a top perspective exploded view of the headstand bench, showing the removable rigid plate and a pair of side rails exploded out form the headstand bench, and a rear pair of legs being folded inwardly.

FIG. 5 is a top perspective view of the headstand bench 10, showing the removable rigid plate 50 and a pair of lower rails 32 exploded out from the bench frame 20, and the rear pair of legs 22*b* folding inwardly via the back-flap hinges 26 that attach each of the front and rear pairs of legs 22 to the pair of lower rails 32. As shown in FIG. 5, in this embodiment, the pair of lower rails 32 may be removed prior to folding the front and rear pairs of legs 22 inwardly to collapse the bench frame 20.

In this embodiment, each of the front and rear pairs of legs 22 includes a recessed portion 66, such that the ends 31 of the pair of lower rails 32 may slidably engage the recessed portions 66 while that the front and rear pairs of legs 22 remain generally smooth. In some embodiments, the bench frame 20 further includes the means of removably attaching 34 the pair of lower rails 32 to the front and rear pairs of legs 22. In this embodiment, the means of removably attaching 34 is in the form of magnets 68 embedded in the recessed portions 66 of the front and rear pair of legs 22 to hold the metallic pair of lower rails 32 in place. In another embodiment, physical fasteners (e.g., pins) may be used, to provide added strength.

As shown in FIG. 5, in this embodiment, a pop pin 28*a* of each locking bracket 28 may further be "popped out" to enable the rear pair of legs 22*b* to hinge inwardly. Alternatively, the legs 22*b* may be removably secured using a different means (e.g., a different type of pin, clip, screw, etc.). In some embodiments, the front and rear pairs of legs 22 are both adapted to fold inwardly so the bench frame 20 is in a folded configuration with the pair of side rails separated from the rest of the bench frame 20 (not shown). As shown in FIG. 5, in this embodiment, there are additional magnets 69 embedded in the pair of upper rails 30 such that when the front and rear legs 22 are in the folded configuration, the magnets 68 align with the magnets 69 to secure the bench 10 in the folded configuration. Alternatively, the magnets 69 may be excluded.

Most prior art exercise benches do not include the removable rigid plate 50 and are lesser in longitudinal length L for ease of storage/transport. However, the present invention is more stable due to the length L relative to W, while being easily disguisable as a piece of sitting furniture, and also collapsible for storage.

Figure 6:
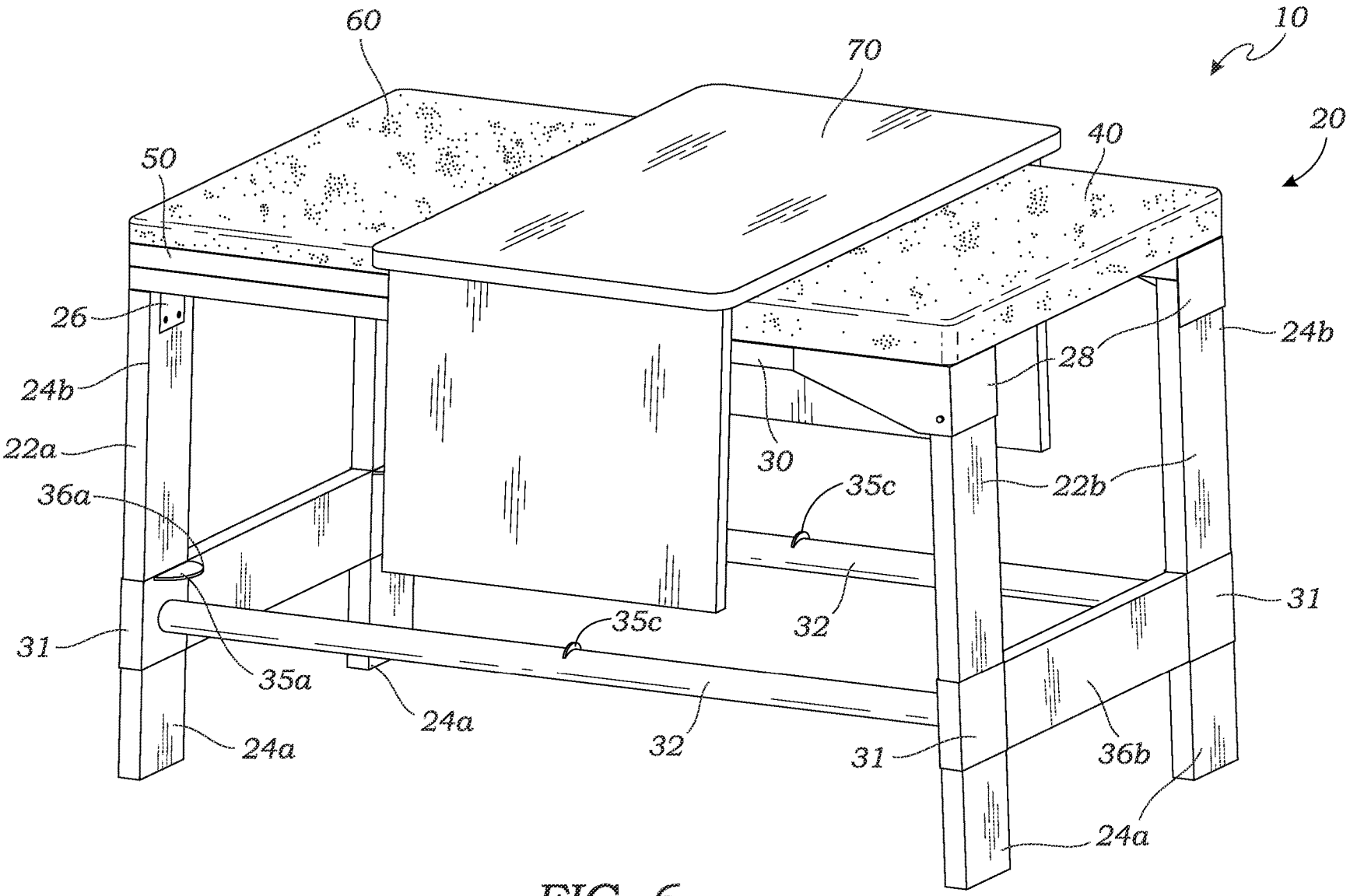
FIG. 6 is a top perspective view of the headstand bench, further illustrating a meditation stool mounted on top of the headstand bench.

FIG. 6 is a top perspective view of the headstand bench 10, further illustrating a meditation stool 70 mounted on top of the headstand bench 10. As shown in FIG. 6, the headstand bench 10 may be used with a variety of different exercise accessories/equipment. In this embodiment, the meditation stool 70 may be used separately from or in combination with the headstand bench 10, or simply stored atop the headstand bench 10 as illustrated. In one implementation of the present invention, the meditation stool 70 may be combined with the headstand bench 10 in various configurations to be used as furniture, e.g., a shelf, table, etc. The meditation stool 70 may be any form of similar stool, which is well known in the art and so will not be further discussed herein.

Figure 7:
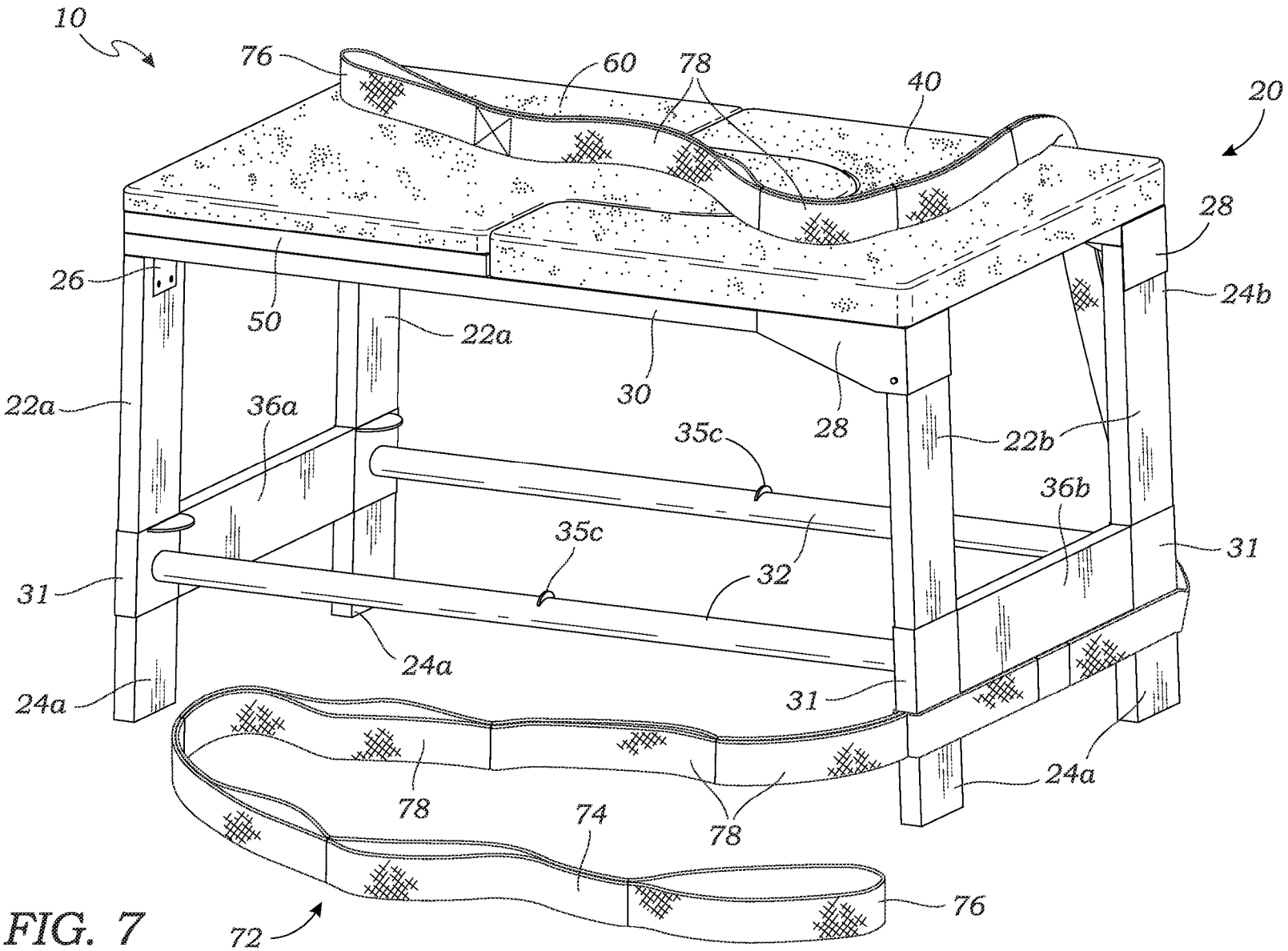
FIG. 7 is a top perspective view of the headstand bench, further illustrating an exercise band mounted on the headstand bench.

FIG. 7 is a top perspective view thereof, further illustrating an exercise band 72 wrapped around the headstand bench 10. As shown in FIG. 7, the headstand bench 10 may be used with the exercise band 72, wherein a user may use the bench frame 20 to create resistance while doing various strengthening/stretching exercises. In this embodiment, the exercise band 72 includes a band body 74 having handles 76 at either end and a plurality of loops 78 therebetween. In some embodiments, the loops 78 may include indicia (not shown) to indicate intensity of resistance and/or number of loops 78.

Figure 8:
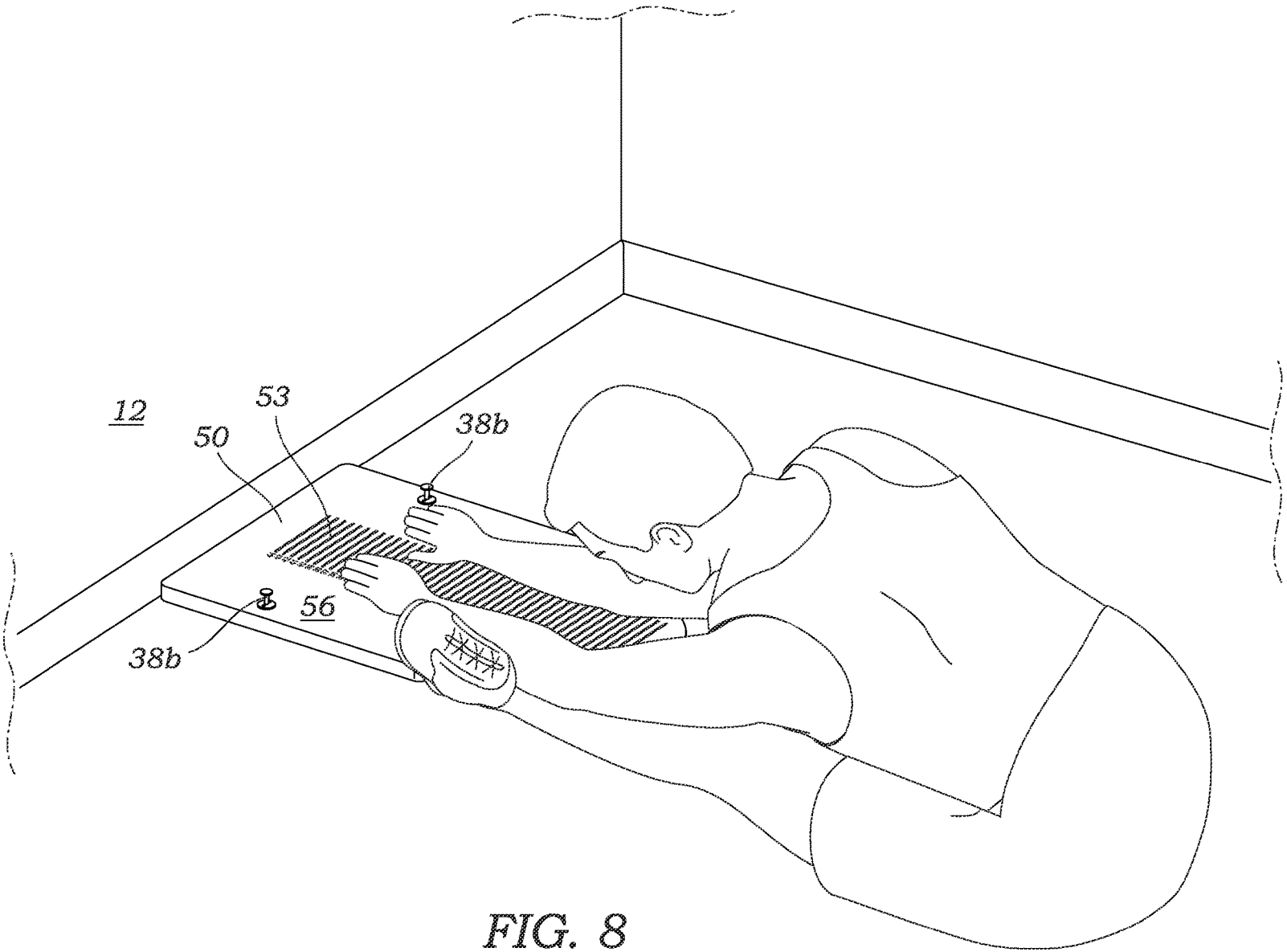
FIG. 8 is a perspective view of a person using the removable rigid plate of FIG. 3 to measure flexibility.

FIG. 8 is a perspective view of a person using the removable rigid plate 50 to stretch against a wall 12. As shown in FIG. 8, in this embodiment, the bottom surface 56 of the removable rigid plate 50 further includes the ruler 53 extending longitudinally from the tab 59 to the opposite outer perimeter edge of the removable cushion 60. The ruler 53 may be in the form of spaced markings (e.g., printed, marked, etched, engraved, etc.) on the bottom surface 56 of the removable rigid plate 50. A person may position the ruler 53 to measure stretches, symmetry, and other exercise metrics. For example, as shown in FIG. 8, the removable rigid plate 50 may be placed against the wall 12 with the bottom surface 56 facing upwardly and used for a "sit and reach" test, to measure hamstring and lower back flexibility, and other forms of flexibility. Other exercise equipment may also be used in conjunction with the present invention, using any means known in the art.

The title of the present application, and the claims presented, do not limit what may be claimed in the future, based upon and supported by the present application. Furthermore, any features shown in any of the drawings may be combined with any features from any other drawings to form an invention which may be claimed.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A headstand bench for performing physical exercises, the headstand bench comprising:

a bench frame having a front pair of legs, a rear pair of legs, each of the front and rear legs having a top end and a bottom end;

the bench frame further including a pair of upper rails extending a longitudinal length between the top ends of the front pair of legs, to the top ends of the rear pair of legs, the pair of upper rails being laterally spaced a width;

the bench frame further including a pair of lower rails extending longitudinally between the front pair of legs to the pair of rear legs, beneath the pair of upper rails;

a headstand plate fixedly mounted on the pair of upper rails adjacent the rear pair of legs, the headstand plate having a cushioned top surface, a bottom surface, and a first inner edge that includes an inwardly extending recessed area that is sized and shaped for performing headstand exercises;

a removable rigid plate adapted to be removably mounted on the pair of upper rails adjacent the front pair of legs via a fastener, the removable rigid plate having a top surface, a bottom surface, and a second inner edge that removably interlocks with the first inner edge of the headstand plate;

a removable cushion removably mounted on the top surface of the removable rigid plate via an attachment mechanism, the removable cushion having a top surface and a bottom surface; and a means for removably securing the removable rigid plate to the pair of lower rails.

2. The headstand bench of claim 1, wherein the longitudinal length of the bench frame is greater than the lateral width.

3. The headstand bench of claim 1, wherein the means for securing the removable rigid plate to the pair of lower rails is in the form of a pair of channels formed in the top surface of the removable rigid plate.

4. The headstand bench of claim 3, wherein the means for securing further includes:

an inwardly extending tab on each end of the pair of lower rails that contacts the pair of front legs;

a pair of indents formed in the bottom surface of the removable rigid plate that receive the tabs when the removable rigid plate is mounted on the pair of lower rails; and an upwardly extending tab on each of the pair of lower rails that contacts the inner edge of the removable inner plate to further secure the inner plate in place.

5. The headstand bench of claim 1, further comprising a locking mechanism for securing the inner edges of the headstand plate and the removable rigid plate in an interlocked position.

6. The headstand bench of claim 5, wherein the locking mechanism is in the form of a side-pull latch comprising: a keeper body mounted on a bottom surface of the headstand plate adjacent the head cutout, and a latch body mounted on a bottom surface of the removable rigid plate adjacent the keeper body of the headstand plate when mounted on the bench frame.

7. The headstand bench of claim 1, wherein the attachment mechanism is in the form of a plurality of pegs formed in the bottom surface of the removable cushion and a plurality of receiving holes of the pair of upper rails, wherein the plurality of pegs and the plurality of receiving holes align when the removable cushion is mounted on the removable rigid plate.

8. The headstand bench of claim 1, further comprising a fastener that includes a pair of clip receivers of the upper rails, and a pair of clips in a bottom surface of the removable rigid plate, wherein the pair of clip receivers and the pair of clips align and interlock when the removable rigid plate is mounted on the bench frame.

9. The headstand bench of claim 1, wherein a bottom surface of the removable rigid plate further includes a ruler extending longitudinally from the inner edge to the opposite edge of the removable cushion.

10. The headstand bench of claim 1, wherein the bench frame further includes a front cross-panel extending laterally between the top and bottom ends of the front pair of the legs, and a rear cross-panel extending laterally between the top and bottom ends of the rear pair of legs.

11. The headstand bench of claim 1, wherein the bench frame has a means for removably attaching the pair of lower rails to the front and rear pairs of legs.

12. The headstand bench of claim 11, further comprising:

a hinge that attaches each of the front and rear pairs of legs to the pair of upper rails, wherein the pair of lower rails may be removed prior to folding the front and rear pairs of legs inwardly to collapse the bench frame.

13. The headstand bench of claim 11, wherein the means for removably attaching is in the form of magnets embedded in the front and rear pairs of legs for magnetically attaching to the pair of lower rails.

14. A headstand bench for performing physical exercises, the headstand bench comprising:

a bench frame having front and rear pairs of legs, and a pair of upper rails extending between the front pair of legs and the rear pair of legs;

a pair of lower rails extending longitudinally between the front pair of legs to the pair of rear legs, beneath the pair of upper rails;

a headstand plate mounted on the pair of upper rails adjacent the rear pair of legs, the headstand plate having a first inner edge that includes an inwardly extending recessed area that is sized and shaped for performing headstand exercises;

a removable rigid plate adapted to be removably mounted on the pair of upper rails adjacent the front pair of legs, the removable rigid plate having a second inner edge that removably interlocks with the first inner edge of the headstand plate;

a removable cushion removably mounted on the removable rigid plate; and a means for removably securing the removable rigid plate to the pair of lower rails.

* * * * *